United States Patent [19]

Sano et al.

[11] 4,034,324

[45] July 5, 1977

[54] DEFLECTION DEVICE FOR USE IN COLOR TELEVISION RECEIVER

[75] Inventors: Shunichi Sano, Zama; Youji Ogawa, Yokohama, both of Japan

[73] Assignee: Tokyo Shibaura Electric Co., Ltd., Kawasaki, Japan

[22] Filed: Sept. 16, 1975

[21] Appl. No.: 613,957

[30] Foreign Application Priority Data

Sept. 20, 1974 Japan ..... 49-109417

[52] U.S. Cl. ..... 335/212; 335/210

[51] Int. Cl.[2] ..... H01F 1/00

[58] Field of Search ..... 335/210, 212

[56] References Cited

UNITED STATES PATENTS

| | | | |
|---|---|---|---|
| 3,247,426 | 4/1966 | Havn | 335/212 |
| 3,622,927 | 11/1971 | Washburn | 335/210 |
| 3,899,710 | 8/1975 | Machida et al. | 335/212 X |
| 3,913,042 | 10/1975 | Talsma | 335/210 |

OTHER PUBLICATIONS

RCA Review, vol. XII, Sept. 1951, No. 3, pp. 612, 613, 619, 625, 628, 629, 640, & 641.

*Primary Examiner*—George Harris
*Attorney, Agent, or Firm*—Cushman, Darby & Cushman

[57] ABSTRACT

A deflection device for use in a color television receiver comprises a deflection yoke fitted to a neck portion of the color television receiver having three horizontally arranged electron guns so designed as to emit three electron beams, for deflecting horizontally and vertically said three electron beams emitted onto a fluorescent screen from the electron guns of the color television receiver, and soft magnetic material pieces fitted to an end portion of the deflection yoke nearer to the screen, for locally varying the distribution of a deflection field generated by the yoke so as to correct mis-convergence of said three electron beams occurring at the peripheral portion of the screen.

5 Claims, 38 Drawing Figures

FIG. 3
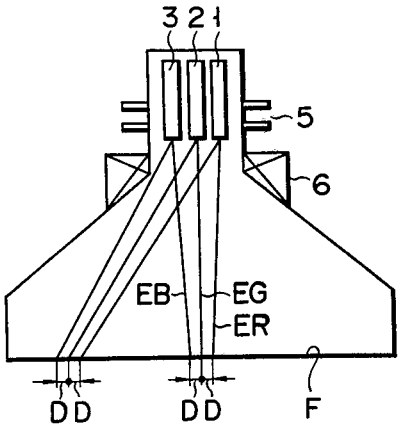
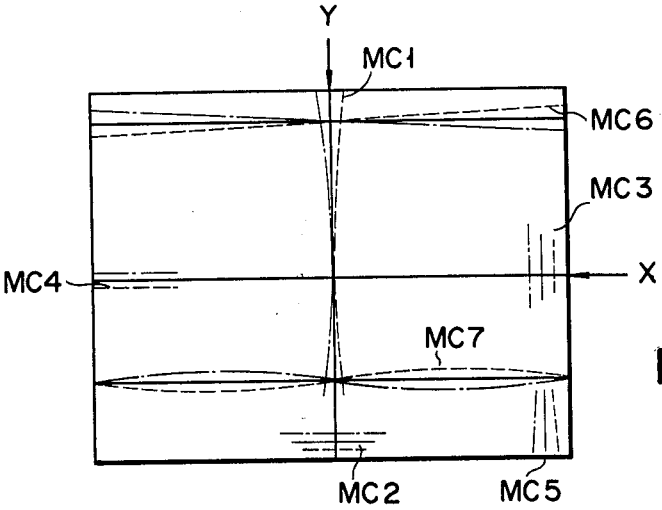
FIG. 4
FIG. 5
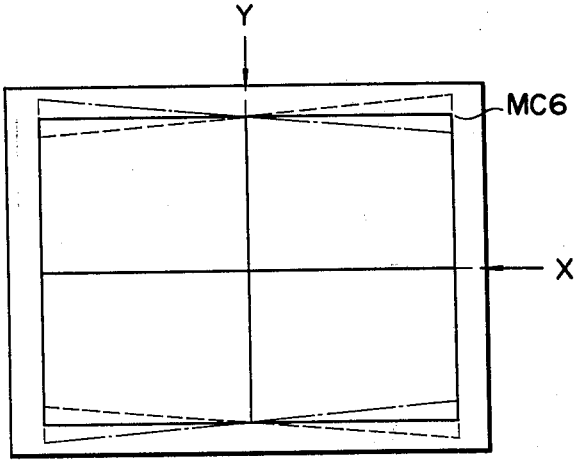

23
a
b
c
Y
X
Θ
φ
21
22
31
31a
31b
32
33
34R
34G
34B
35
36
37G
37B
38R
38G
38B
SR
SG
SB
ER
EG
EB
L
D
d
α

MAGNETIC FIELD INTENSITY (RELATIVE VALUE)
100
50
BH
-100
-50
0
50
(REAR) ← POSITION Z ON THE Z AXIS (mm) → (FORWARD)

MAGNETIC FIELD INTENSITY (RELATIVE VALUE)
100
50
BV
-100
-50
0
50
(READ) ← POSITION Z ON THE Z AXIS (mm) → (FORWARD)

DEFLECTION DEVICE FOR USE IN COLOR TELEVISION RECEIVER

This invention relates to a deflection device for use in a color television receiver, used in a three-electron beam type color picture tube wherein reproduction of a picture image is effected by causing three electron beams corresponding to three primary colors of red, green and blue to scan a fluorescent screen in both horizontal and vertical directions while said three electron beams being allowed to impinge upon said screen.

Figure 1:
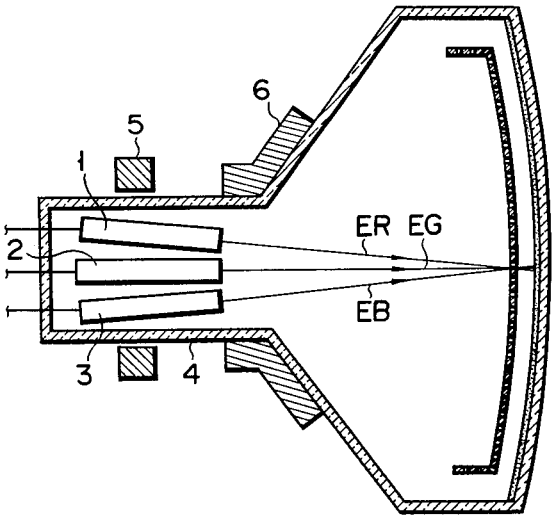
FIG. 1 PRIOR ART

The three-electron beam type color picture tube should be so constructed that when the three electron beams corresponding to red, green and blue scan the fluorescent screen of the color picture tube, the rasters of the three primary colors are overlapped by permitting the three electron beams to be converged, for the purpose of preventing the occurrence of color displacement due to mis-convergence of said three electron beams. To this end, in a color picture tube of a so-called in-line arranged beam system wherein three electron beams are emitted in a state wherein they are arranged in a horizontal plane, electron guns 1, 3 at both opposite sides of a central electron gun 2 shown in FIG. 1 are usually disposed respectively horizontally inclined at prescribed angles to the central electron gun. In an actually manufactured color picture tube unit, however, three electron beams ER, EG and EB are not always converged at one point due to a low accuracy with which the electron guns are arranged, the effect of an external magnetic field, etc. To solve this problem, a static convergence yoke 5 is usually fitted to a neck portion 4 of the color picture tube and a so-called static convergence is effected by this yoke 5 so as to permit the three-electron beams to be completely converged at least at the screen center.

Even in a color picture tube so constructed that the three electron beams ER, EB and EG are converged at the screen center by effecting the static convergence as above mentioned, in cases where the three electron beams are deflected by a deflection yoke 6 up to the peripheral portion of the screen, they fail to be converged at one point, that is, a mis-convergence occurs. The reason is that the three electron guns 1, 2 and 3 are disposed spatially separately from each other. In order to zero this mis-convergence, a dynamic convergence is generally carried out. For the purpose of effecting the dynamic convergence, as shown in, for example, FIG. 2, a pair of cores 7*a*, 7*b* are disposed, respectively, at both opposite sides of a neck portion 6 of the color picture tube and dynamic convergence windings 8*a*, 9*a*, 10*a* and 8*b*, 9*b*, 10*b* are wound, respectively, about said pair of cores, and a dynamic correcting current is supplied from a dynamic convergence control circuit 11 to said windings 8*a*, 8*b*, 9*a*, 9*b*, 10*a* and 10*b*. Note that in FIG. 2 reference numerals 12, 13 and 14, 15 denote permanent magnets for effecting a static convergence. The above-mentioned dynamic correcting current is made to have a suitable waveform so as to correct in accordance with the line scanning rate, field scanning rate, etc. the paths of the side beams ER and EB of the three electron beams (ER, EG, EB of FIG. 1) emitted from the electron guns 1, 2 and 3, in order to attain a sufficient convergence at all points of the screen. Accordingly, a circuit for supplying said correcting current, i.e., said dynamic convergence control circuit 11 generally becomes extremely complicated in construction and simultaneously the power consumption in this circuit 11 becomes large. In cases where, in a shadow mask type color receiving tube as presently widely used, a dynamic convergence is carried out, the incident angle of the three electron beams incident into the shadow mask is also varied as this dynamic convergence is effected. Accordingly, when it is desired to obtain a desired color purity, a correcting device used for light exposure in forming a fluorescent screen also becomes complicated.

The above-mentioned problems encountered where the dynamic convergence is carried out are becoming more and more remarkable with the widening of a deflection angle for the electron beams of the color picture tube (at present, there is a tendency that a wide-angled Braun tube of 110° or more is favourably used), or with application of higher anode voltage. In the case of, for example, a color picture tube 20 inch in screen size and 110° in electron beam-deflecting angle, the dynamic convergence control circuit 11 has 10 or more portions to be readjusted. In such a case, the manufacturer needs a long time to perform the convergence-correcting operation, which results in a costly color picture tube. Further, there is an inconvenience that difficulties are encountered in performing quickly and properly the above-mentioned readjustment upon a domestic replacement of the color picture tube.

The color picture tube of in-line arranged beam system is somewhat simplified in respect of the construction of its circuit device for effecting the above-mentioned dynamic convergence as compared with the conventionally widely used color picture tube of Δ-arranged beam system but if possible, it is strongly desired for the color picture tube to require no dynamic convergence-operation at all.

There have in recent years been contemplated various color picture tubes which eliminate the necessity of performing the dynamic convergence, for example, through making the magnetic field distribution of the deflection device appropriate and yet reducing the manufacturing errors. For example, U.S. Pat. No. 2,764,628 describes in its specification that three horizontally arranged electron beams are allowed to scan directly the fluorescent screen without being converged, and three primary color signals for modulating the three electron beams are delayed by a length of time corresponding to the interval between the three parallel emitted electron beams, thereby to prevent the color pictures from being subjected to color displacement. This system will indeed well serve the purpose if the deflection field is not distorted at all by the deflection yoke, but in the case of an actual deflection yoke it is impossible to zero the distortion of the deflection field. The color picture tube of this system, therefore, has no realizability.

Under these circumstances, the present inventors have contemplated a color picture tube which does not have the above-mentioned drawbacks. As shown in FIG. 1, in this color picture tube, the direction and position in which the three electron guns 1, 2 and 3 are disposed are so determined that electron beams ER, EG and EB emitted from the three electron guns 1, 2 and 3 are converged at a point outside of a fluorescent screen F. A deflection yoke 6 for deflecting the three electron beams ER, EG and EB is so designed as to generate a deflection field whose distribution has an appropriate distortion. Three primary color signals for modulating the three electron beams ER, EG and EB are respectively delayed by a length of time corresponding respectively to the intervals D between those points of the fluorescent screen F upon which the three electron beams ER, EG and EB impinge at a point of time. Accordingly, the three electron beams ER, EG and EB scan the fluorescent screen under the requirements that they impinge upon a given region of the fluorescent screen F substantially at prescribed intervals, to permit each of phosphor dots provided on the fluorescent screen to emit a necessary amount of fluorescent light. On the other hand, the three primary color signals for modulating the three electron beams ER, EG and EB are respectively given a prescribed length of delay time in corresponding relationship to a length of time corresponding to the above-mentioned intervals D. Thus, this color picture tube exhibits the same function as that in the case where the three electron beams ER, EG and EB scan the fluorescent screen while being kept converged at one point of the fluorescent screen. The color picture tube having the foregoing construction, however, still remains to have the following problems.

Usually, where, in the color picture tube of in-line arranged beam system, the three electron beams as emitted are deflected by the deflection yoke, they are mis-converged as shown in FIG. 4. That is to say, when it is assumed that a horizontal one of two axes passing through a screen center and intersecting at right angles to each other is represented by X and a vertical one of said two axes by Y. Then, the following mis-convergences occur. That is, a mis-convergence $MC_1$ wherein the three electron beams are horizontally displaced from each other at both the upper and lower end portions of the Y axis and a mis-convergence $MC_2$ wherein the three electron beams are vertically displaced from each other at both the upper and lower end portions of the Y axis, a mis-convergence $MC_3$ wherein the three electron beams are horizontally displaced from each other at both the right and left end portions of the X axis and a mis-convergence $MC_4$ wherein the three electron beams are vertically displaced from each other at both the right and left end portions of the X axis, a mis-convergence $MC_5$ wherein the three electron beams are horizontally displaced from each other at the diagonal end portions of the screen and a mis-convergence $MC_6$ wherein the three electron beams are vertically displaced from each other at the diagonal end portions of the screen, and a mis-convergence $MC_7$ wherein scanning lines at the proximities of both the upper and lower ends of the screen coincide with each other at the respective proximities of the Y axis and the right and left ends of the screen and are vertically displaced at intermediate portions between the Y axis and each of said right and left ends of the screen.

The $MC_2$ and $MC_4$ of the above-mentioned mis-convergence occur due to errors in arranging the electron guns, errors in attaching the deflection yokes, or unsymmetry of the deflection yokes, but can be adjusted by constructing an attaching mechanism for electron guns and an attaching mechanism for attaching deflection yokes to a color picture tube so that each of these mechanisms may have a correcting function. That is to say, said $MC_2$ and $MC_4$ can readily be corrected by simple adjusting mechanisms mounted on a conventional picture tube and deflection yoke.

The $MC_1$ can be removed by distorting into an appropriate barrel-configuration the distribution of a magnetic field produced by vertical deflection coils. The $MC_3$ can be removed by distorting into an appropriate pincushion-configuration the distribution of a magnetic field produced by horizontal deflection coils. Further, the $MC_5$ can be substantially zeroed by removing said $MC_1$ and $MC_3$.

Where attempts are made to remove the $MC_1$ and $MC_3$ by varying the winding distribution of each deflection coil, either one of the $MC_6$ and $MC_7$ necessarily occurs, that is to say, it is impossible to remove both of them at the same time the $MC_6$ and $MC_7$ run counter to each other, that is, are related to each other in such a manner that if either one of them becomes small, the other becomes large. In the prior art, no attempt was made to completely remove any one of the $MC_6$ and $MC_7$. That is, in the prior art, at ten or more portions of the color picture tube adjustment was so made as to permit the $MC_6$ and $MC_7$ to be equalized in degree with each other thereby to prevent occurrence of an extremely large mis-convergence, or alternatively arrangement was so made as to permit misconvergences to occur at the peripheral portion of the screen where mis-convergences are relatively not outstanding. Accordingly, in the case of time indication or score display of baseball, a viewer has heretofore viewed a deteriorated picture image.

The above-mentioned reciprocal relationship between the $MC_6$ and $MC_7$ is established also in the case of the above-mentioned color picture tube of FIG. 3.

The object of the invention is to provide a deflection device for use in a color television receiver wherein soft magnetic material pieces having a configurational anisotropy, for example, rectangular soft iron pieces are fitted to the front end portion of a deflection yoke mounted on an in-line arranged three-electron beam type color picture tube, that is, to an end portion of the deflection yoke on the screenside, whereby the distribution of a deflection field produced by the deflection yoke is locally varied so as to correct the mis-convergence of in-line arranged three-electron beams occurring at four corners of the screen thus to achieve a good convergence over a substantially entire region of the screen.

According to the present invention there can be obtained a deflection device which comprises a deflection yoke fitted to a neck portion of a color picture tube provided with three electron guns emitting three electron beams in a state arranged in a horizontal plane, said deflection yoke being horizontally and vertically, and soft magnetic material pieces fitted to an end portion of the deflection yoke nearer to the screen, whereby the distribution of deflection field from the deflection yoke is varied by the soft magnetic material pieces to correct mis-convergences.

Figures 6A, 6B, 7, 8:
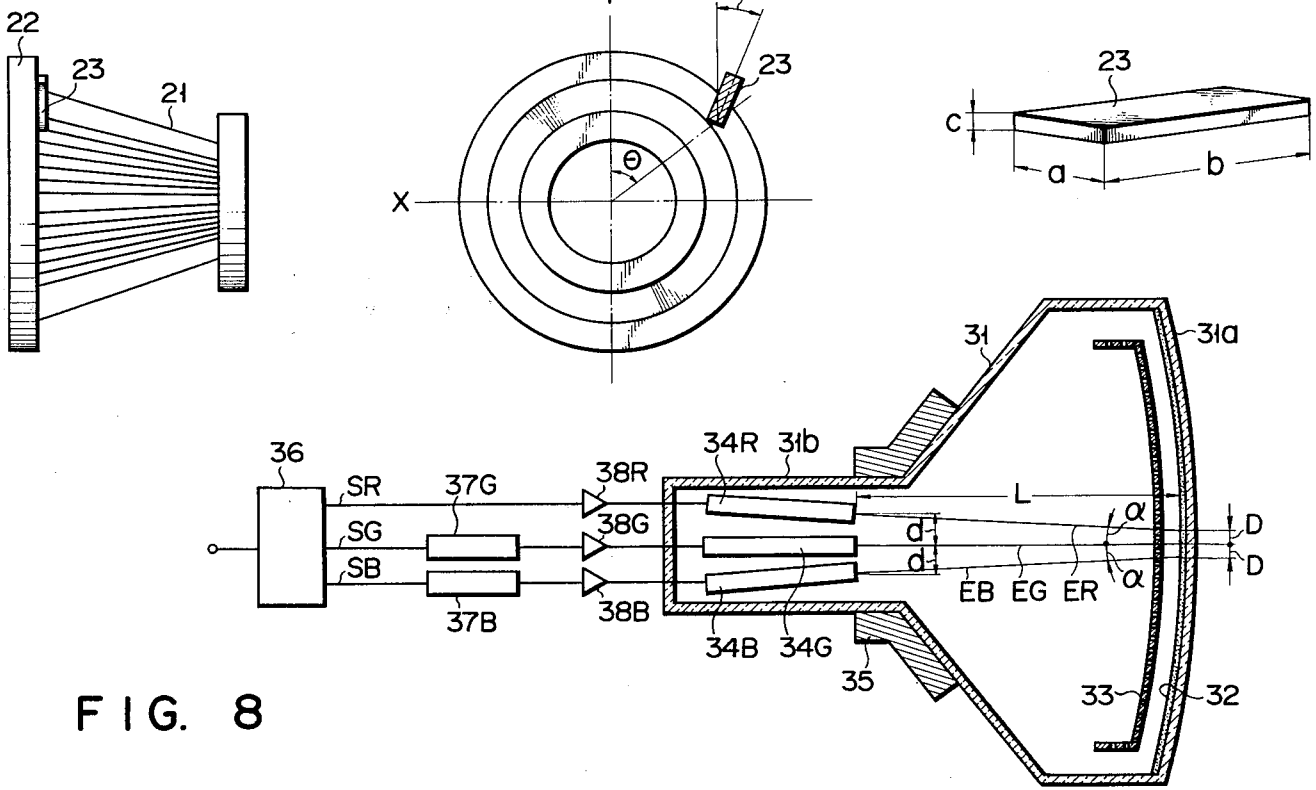

The present inventors have found that the above-mentioned mis-convergences $MC_6$ and $MC_7$ can be both removed at the same time if the following measures are taken. A first measures is to prepare vertical and horizontal deflection coils so designed that they can remove the $MC_1$ and $MC_3$, respectively, and also remove the above $MC_7$. With respect to the $MC_6$ occurring at corners of the screen as shown in FIG. 5, a magnetic material piece free from permanent magnetization, for example, a soft magnetic material piece 23 is fitted to the front end portion of a deflection yoke 21, that is, to a yoke holder 22 as shown in FIGS. 6A, 6B and 7, thereby to locally vary the distribution of deflection field, thus to remove the $MC_6$ utilizing the relative movement of the three electron beams made in accordance with the variation of the deflection field distribution. If arrangement is made as such, a dynamic convergence becomes unnecessary. Therefore, a great advantage results. Note here that what is important is that unless a material free from permanent magnetization is used as said magnetic material piece, the effect of the invention can not be obtained. This material should be magnetically soft, namely, is a soft magnetic material. Have it in mind that it is important to locally vary the distribution of magnetic field produced by the deflection yoke 21 so as to remove the $MC_6$ of FIG. 5 without affecting the convergence at the remaining region of the screen, through adjusting the size (width a, length *b* and thickness *c*), the attachment position (an angle $\theta$ defined by the piece 23 with a vertical line Y in the case where the piece 23 is fitted to the picture tube), or the attachment angle (an inclined angle $\Psi$ defined by the longitudinal axis of the piece 23 with said vertical line Y) of the magnetic material piece 23.

Figure 2:
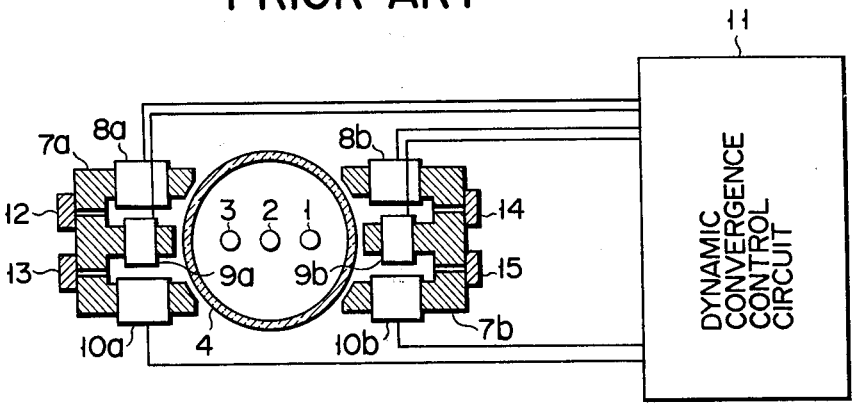
FIG. 2 PRIOR ART

This invention can be more fully understood from the following detailed description when taken in conjunction with the accompanying drawings, in which:

FIGS. 1 to 4 are intended to explain the object of the present invention, FIG. 1 being a sectional view schematically showing a prior art color picture tube, FIG. 2 showing a dynamic convergence means fitted to the prior art color picture tube.

Figure 9:
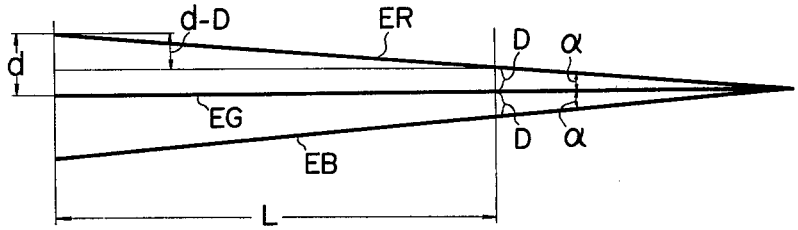
Figure 10A:
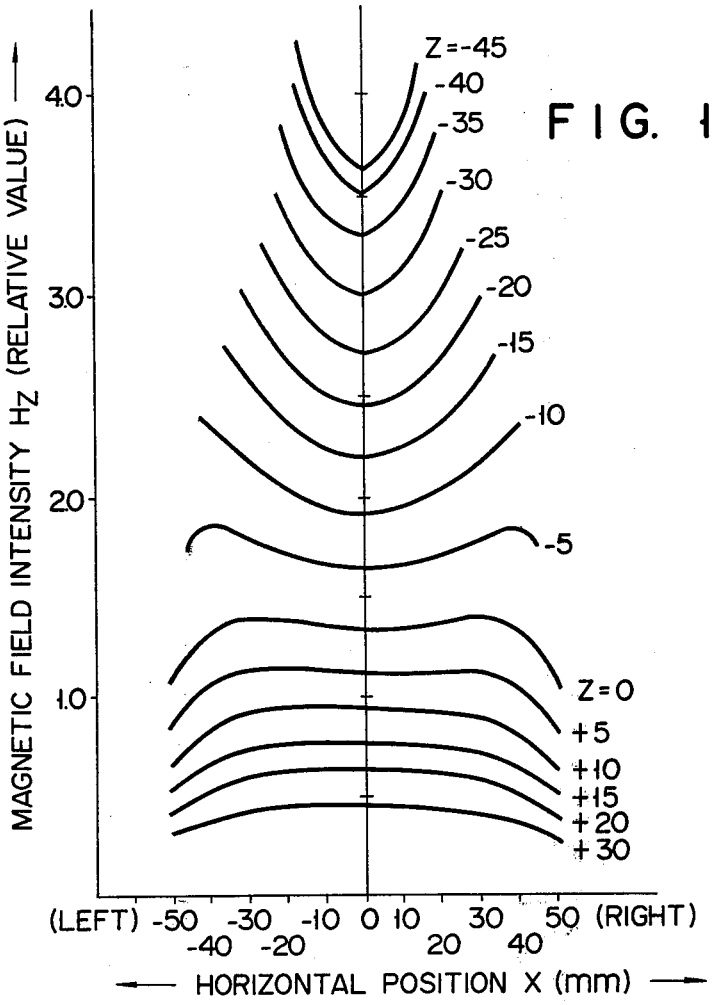
Figure 10B:
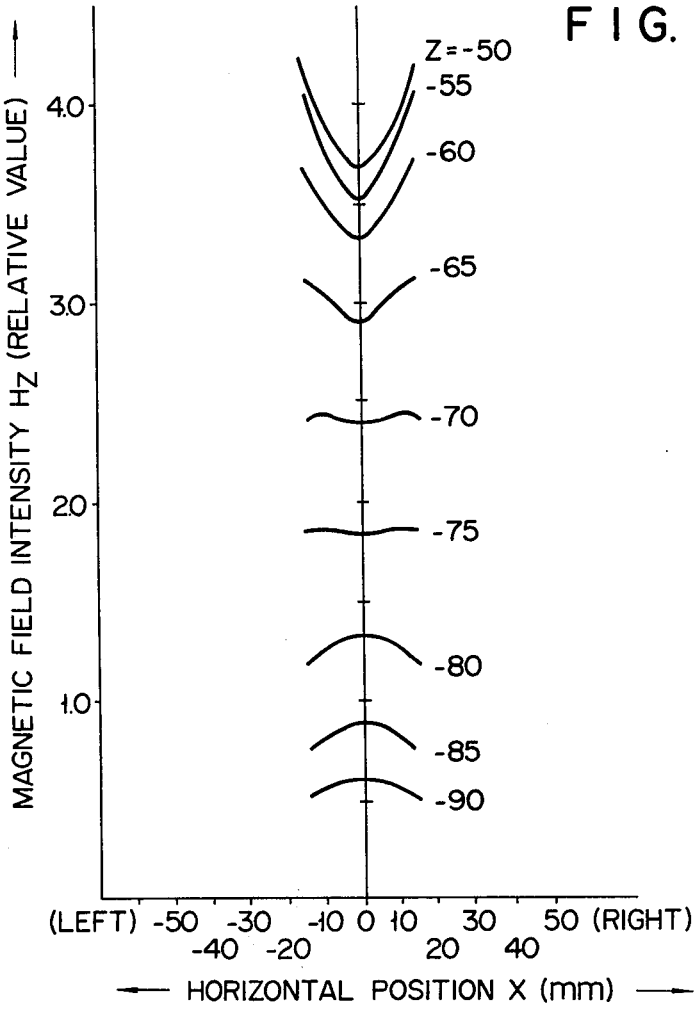
Figure 14:
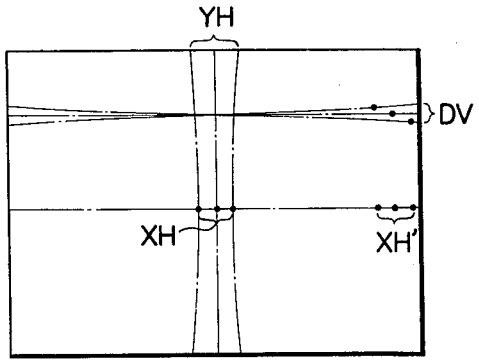
Figure 14A:
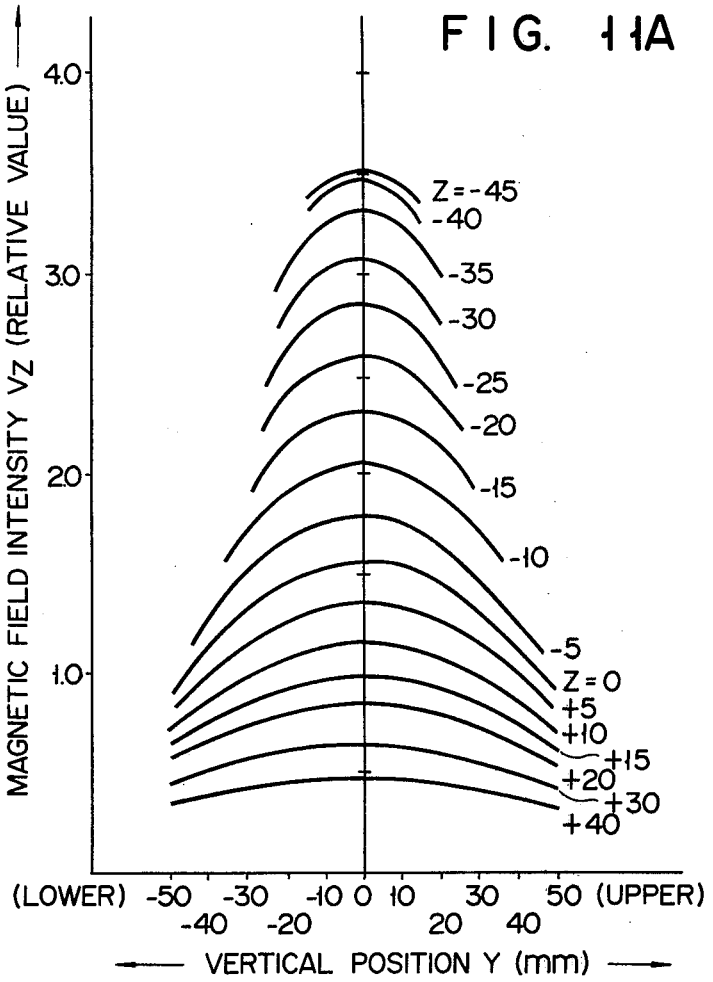
Figure 15A:
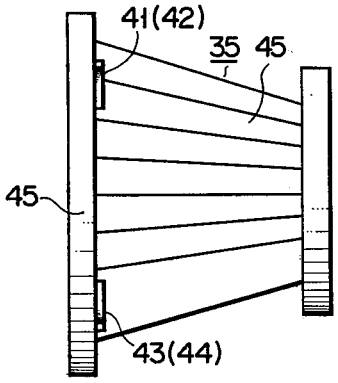
Figure 15B:
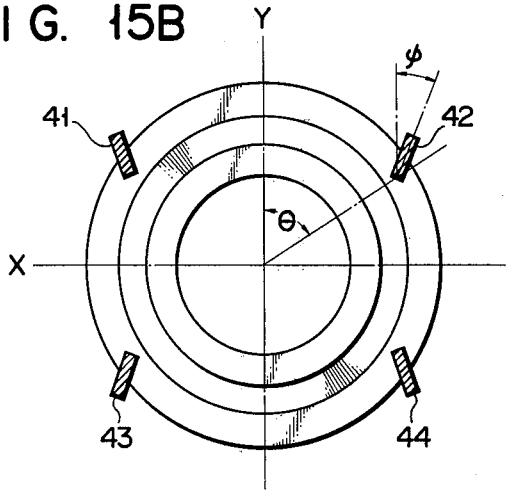
Figure 11B:
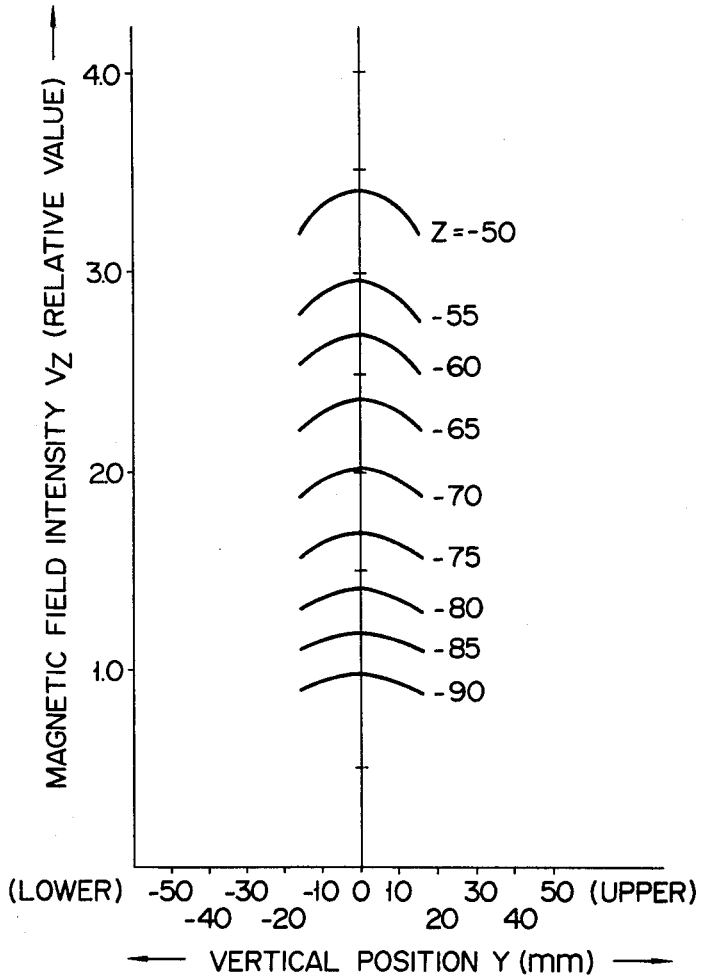
Figure 16:
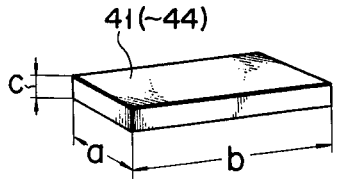
Figure 12:
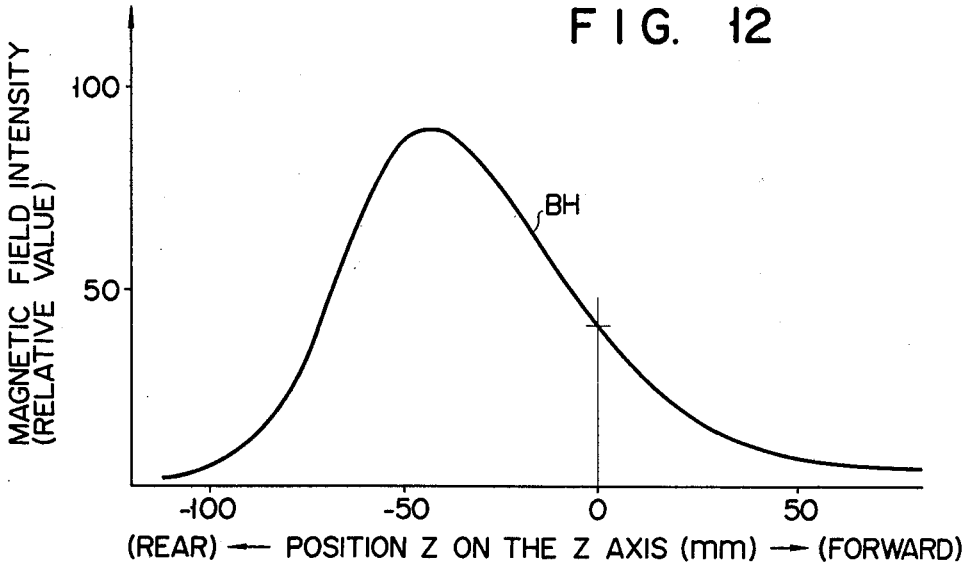
Figure 13:
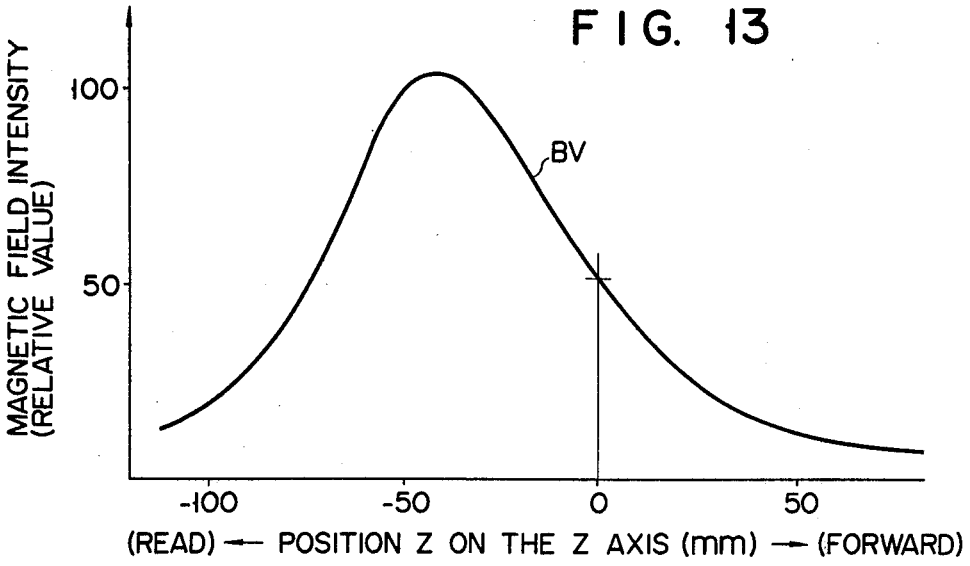
Figure 18A:
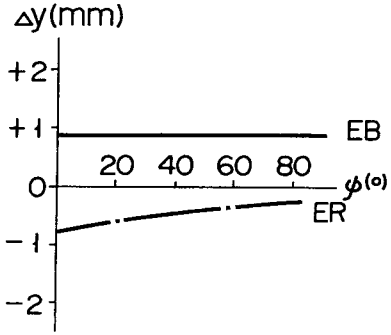
Figure 18B:
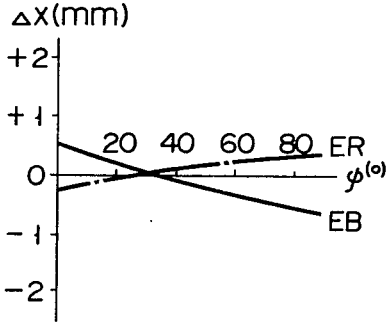
Figure 17A:
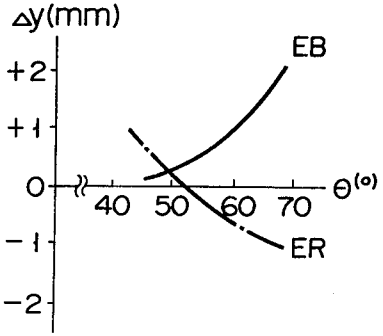
Figure 17B:
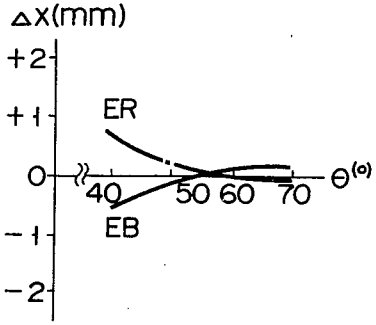
Figure 19A:
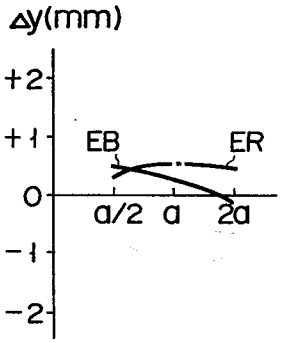
Figure 19B:
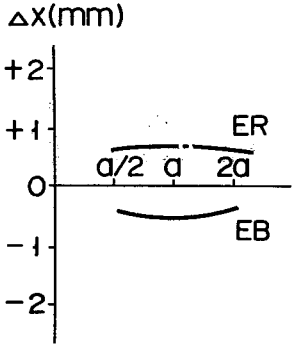
Figure 19C:
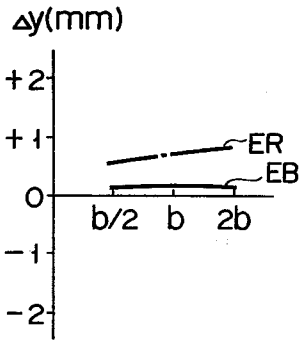
Figure 19D:
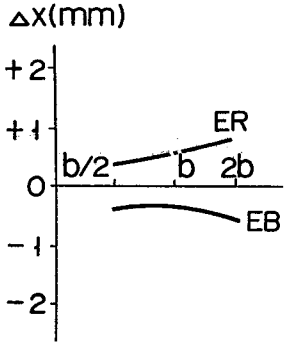
Figure 19E:
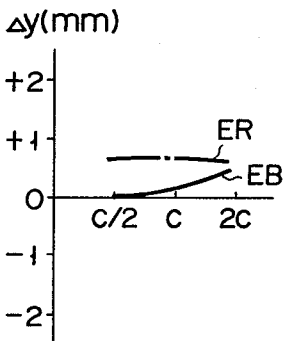
Figure 19F:
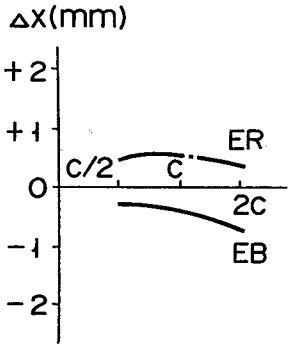
Figure 20A:
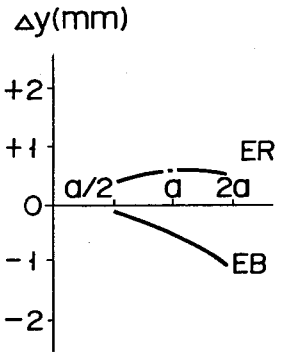
Figure 20B:
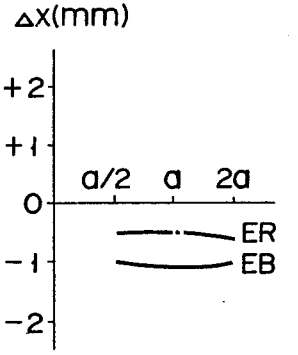
Figure 20C:
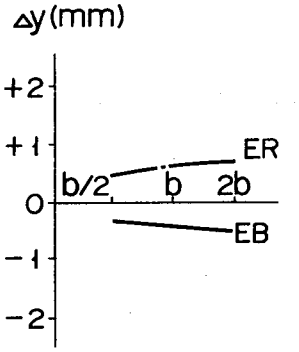
Figure 20D:
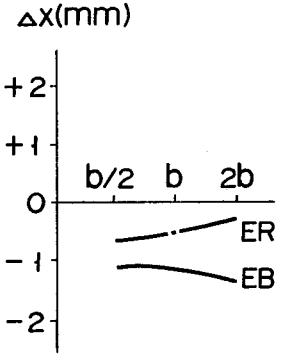
Figure 20E:
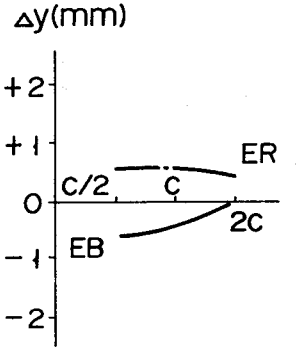
Figure 20F:
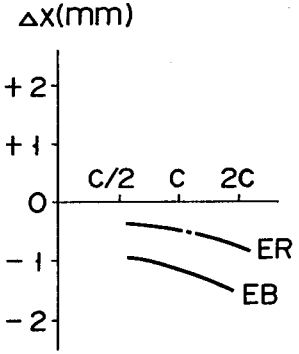

FIG. 3 schematically showing a color picture tube wherein color displacement is corrected by giving a prescribed length of delay time to each of modulation signals of three electron beams without causing said three electron beams to be converged on a fluorescent screen of the color picture tube, FIG. 4 being intended to explain mis-convergences in a color picture tube of in-line arranged beam system;

FIGS. 5 to 7 are intended to explain the fundamental principle of the present invention, FIG. 5 showing the condition wherein mis-convergences occur only at four corners of the screen, FIGS. 6A and 6B being respectively side and rear views showing the condition wherein a soft magnetic material piece is fitted to a deflection yoke, FIG. 7 being a perspective view of the soft magnetic material piece; and FIGS. 8 to 22 show an embodiment of the present invention, FIG. 8 showing respective details of a shadow mask type color picture tube and a three-primary color signal supply section, FIG. 9 showing the relations between inclined angles of electron beams and various values associated with said inclined angles, FIGS. 10A and 10B being curve diagrams showing the distribution of deflection field from a horizontal deflection coil, FIGS. 11A and 11B being curve diagrams showing the distribution of deflection field from a vertical deflection coil, FIGS. 12 and 13 showing respectively the variations in intensity of magnetic fields produced from the horizontal and vertical deflection coils, as viewed on the Z axes thereof, FIG. 14 being intended to explain the positional displacement of three electron beams on the fluorescent screen, FIGS. 15A and 15B being respectively side and rear views showing the condition wherein soft magnetic material pieces are fitted to a deflection yoke, FIG. 16 being a perspective view of the soft magnetic material piece, FIGS. 17A and 17B showing vertical and horizontal movements of the three electron beams relative to the variation of the attachment position of the soft magnetic material piece, FIGS. 18A and 18B showing vertical and horizontal movements of the three electron beams relative to the variation of the attachment angle of the soft magnetic material piece, FIGS. 19A, 19B, 19C, 19D, 19E, 19F, 20A, 20B, 20C, 20D, 20E and 20F showing individually vertical and horizontal movements of the three electron beams relative to the variation in width, length and thickness of a rectangular magnetic material piece.

Figure 21:
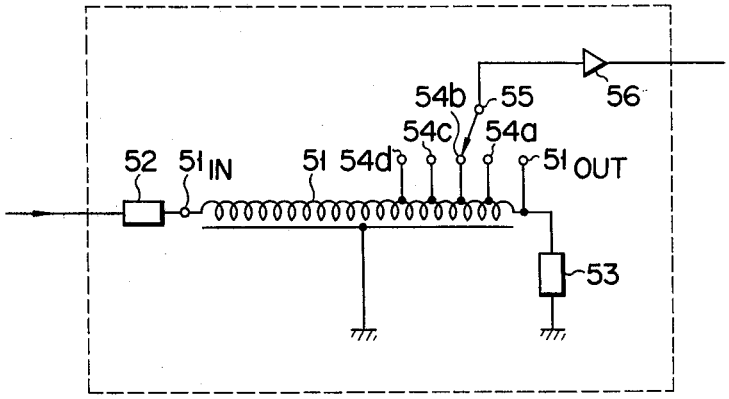
Figure 22:
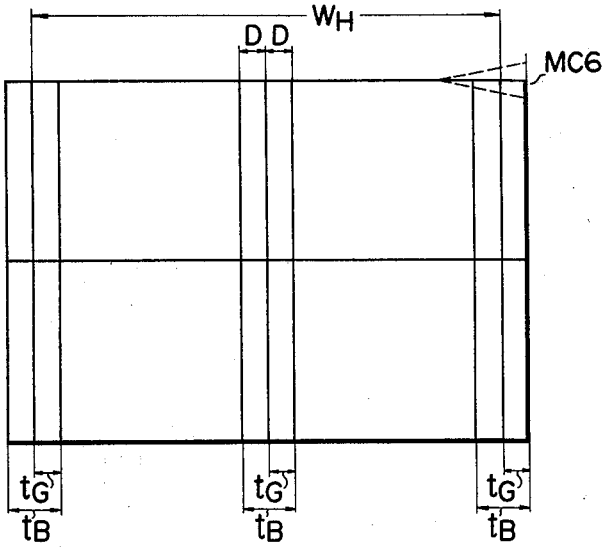

FIG. 21 showing a detailed arrangement of a delay circuit,

FIG. 22 being intended to explain the operation of this embodiment.

FIG. 8 shows the detail of a shadow mask type color picture tube constituting the main part of a color television receiver to which the present invention is applied and the detail of a three-primary color signal supply section for supplying three primary color signals to said color picture tube. In FIG. 8, a glass bulb 31 is a vacuum envelope having at its front portion a face plate 31*a* constituting a screen of the color television receiver and at its rear portion a neck portion 31*b* whose diameter is made small. In the inner surface of the face plate 31*a* of the glass bulb 31 is formed a fluorescent screen 32 on which are arranged in a regular order phosphor dots which, when three electron beams have impinged thereupon, emit three color television primary colors of red (R), green (G) and blue (B). At a position a little shifted from the surface of the fluorescent screen 32 toward the incident side of the electron beams is disposed a shadow mask 33 having a large number of small holes (not shown) corresponding to the phosphor dots of the fluorescent screen 32. Within the neck portion 31*b* of the glass bulb 31 are arranged three electron guns 34R, 34G and 34B, which are in-line arranged horizontally to the screen. These electron guns 34R, 34G and 34B are so constructed as to emit toward the fluorescent screen 32 three electron beams ER, EG and EB modulated by three primary color signals SR, SG and SB as later described, respectively. Further, these three electron guns 34R, 34G and 34B are arranged such that both side-electron guns 34R and 34B are inclined in the same horizontaal plane at a prescribed angle $\alpha$ to the center electron gun 34G so as to permit the three electron beams ER, EG and EB to be converged at one point in a region outside of the fluorescent screen 32, that is, outside of the face plate 31*a*. Since, as above described, a converged point of the three electron beams ER, EG and EB is situated outside of the fluorescent screen 32, these three electron beams impinge, at intervals D, upon the surface of the fluorescent screen 32.

Further in detail, when $\alpha$ represents the inclined angle of the electron guns 34R, 34G and 34B, *d* represents the intervals between the three electron beams at the electron beam-emitting ends of the electron guns (in other words, the mutual intervals between the center positions of those ends of the electron guns from which to emit the electron beams ER, EG and EB), and L represents the distance between the forward, or electron beam-emitting end of the electron guns and the fluorescent screen 32, the mutual relation between said, $\alpha$, $d$ and L is so determined as to satisfy the following inequality.

$$d/6 < d - L\alpha\ d/2 \quad (1)$$

That is to say, the difference between the interval $d$ (mm) between the forward ends of the electron guns, and a product $L\alpha$ obtained by multiplying the angle $\alpha$ (rad.) defined by both side-electron beams ER, EB with the center electron beam EG by the distance L between the forward end of the electron guns and the fluorescent film 32, namely, d-$L\alpha$, is so determined that it is greater than $d/6$ and smaller than $d/2$.

The $d - L\alpha$ of the above inequality (1) is substantially equal to said interval D between the electron beam spots on the fluorescent screen 32. That is, since, as apparent from FIG. 9, $\tan\alpha = (d-D)/L$, $D \div d - L\alpha$. In order to obtain a high resolution, it is preferred that 6.5 mm $< d$ and that, in the case where the fluorescent screen size ranges from 14 inch-tube to 25 inch-tube, 1 mm $< D <$ 5 mm.

For reference, a color picture tube manufactured for experimental use is of the following dimensions.

| | |
|---|---|
| Fluorescent Screen Size | 20 inch-tube |
| Electron Beam-Deflecting Angle | 110° |
| Outer Diameter of the Neck Portion | 36.5 $\phi$ |
| Inclined Angle $\alpha$ of Electron Beam | 1.06° |
| Distance Between the Forward End of the Electron Gun and the Fluorescent Screen | 280 mm |
| Interval Between the Forward Ends of the Electron Guns | 8.2 mm |
| Interval Between the Electron Beam Spots on the Fluorescent Screen | 2.5 mm |
| Distance Between the Converged Point of the Electron Beams and the Fluorescent Screen | 160 mm |

A deflection yoke 35 is fitted to the outer periphery of the neck portion 31*b* of the glass bulb 31. This deflection yoke 35 has horizontal and vertical deflection coils producing magnetic fields for horizontally and vertically deflecting said three electron beams ER, EG and EB. Said horizontal deflection coil is so formed that a magnetic field distribution formed by this horizontal deflection coil may assume a so-called pincushion shape wherein the magnetic field intensity becomes gradually high as the measuring position horizontally goes away from the axial center of the deflection yoke 35. Said vertical deflection coil is so formed that a magnetic field distribution formed by this vertical deflection coil may assume a so-called barrel shape wherein the magnetic field intensity becomes gradually low as the measuring position vertically goes away from the axial center of the deflection yoke 35.

FIGS. 10A and 10B are curve diagrams showing the magnetic field distribution of a horizontal deflection coil 35H with a radially (horizontally) shifted position from the axial center of the deflection yoke 35 plotted on the abscissa and the magnetic field intensity (relative value) plotted on the ordinate and a position on the Z axis of the deflection yoke 35 taken as a parameter. In FIGS. 10A and 10B, however, numerical values indicating the positions on the Z axis are defined as follows. That is to say, $Z = 0$ (mm) is defined to indicate the position of the forward end (the screen side) of the horizontal deflection coil, and positive values ($Z >$ 0) are defined to indicate positions shifted forwardly of this position, that is, positions shifted toward the screen while negative values ($Z < 0$) are defined to indicate positions shifted rearwardly of that position, that is, positions going away from the screen. At this time, the position of the rear end of the horizontal deflection coil is represented by $Z = -80$ mm. Similarly, FIGS. 11A and 11B are curve diagrams showing the magnetic field distribution of a vertical deflection coil 35V with a radially (vertically) shifted position from the axial center of the deflection yoke 35 plotted on the abscissa and the magnetic field intensity (relative value) plotted on the ordinate and a position on the Z axis of the deflection yoke 35 taken as a parameter. Numerical values indicating the positions on the Z axis are defined in the same manner as in FIGS. 10A and 10B.

As apparent from FIGS. 10A and 10B, in the region where the deflecting magnetic field on the axial center (Z axis) of the deflection yoke 35 has an intensity of ½ the maximum value, the magnetic field distribution of the horizontal deflection coil 35H assumes a pincushion shape wherein the magnetic field intensity becomes gradually high as the measuring position radially (horizontally) goes away from the Z axis. As apparent from FIGS. 11A and 11B, the magnetic field distribution of the vertical deflection coil 35V assumes a barrel shape wherein the magnetic field intensity becomes gradually low as the measuring position radially (vertically) goes away from the Z axis of the deflection yoke 35.

FIG. 12 shows for reference the variation of a horizontally deflecting magnetic field intensity BH on the axial center (Z axis) of the deflection yoke 35, and FIG. 13 similarly shows for reference the variation of a vertically deflecting magnetic field intensity BV. The BH curve of FIG. 12 corresponds to the magnetic field distribution curve of FIGS. 10A and 10B while the BV curve of FIG. 13 corresponds to the magnetic field distribution curve of FIGS. 11A and 11B.

The main reason of using the deflection yoke 35 having the above-mentioned magnetic field distribution is to make zero any of both the difference $YH - XH$ (this difference corresponds to said $MC_1$) where $YH$ represents the interval between the electron beam spots at both the upper and lower ends of the screen and $XH$ the interval between the electron beam spots at the center of the screen and the difference $XH - XH'$ (this difference corresponds to said $MC_3$) where $XH'$ represents the horizontal interval between the electron beam spots at both the right and left ends of the screen. Note that in FIG. 14 DV represents the vertical interval between the electron beam spots at both the right and left ends of the screen.

By the use of the deflection yoke 35 having the above-mentioned construction all the mis-convergences shown in FIG. 4 can be substantially removed except for said $MC_6$, but through a complete removal of the $MC_7$ the $MC_6$ is relatively allowed to occur to an extent of about 1 mm. Hereinafter, how to zero this $MC_6$ is described.

As shown in FIG. 15A, to the front end portion of the deflection yoke 35, that is to say, to an end portion of the deflection yoke 35 on the side of the screen are fitted four soft rectangular magnetic material pieces 41, 42, 43 and 44 in order to correct mis-convergences of the three electron beams occurring at the peripheral portion of the screen. That is to say, these soft magnetic material pieces 41 to 44 are fitted to one side face of a yoke holder 45 for the deflection yoke 35, at a position inclined, as shown in FIG. 15B, at an angle $\theta$ to a vertical line Y in the case where the deflection yoke 35 is mounted on the color picture tube. Accordingly, said four soft magnetic material pieces 41 to 44 are disposed substantially axis-symmetrical about said vertical line Y and a horizontal line X intersecting said vertical line Y at right angles thereto (these vertical and horizontal lines Y and X are hereinafter referred to as Y axis and X axis, respectively). The soft magnetic material pieces 41 to 44 have a configurational anisotropy through forming a magnetic material such as permalloy into a thin, rectangular sheet-like configuration as shown in FIG. 16, and so act as to locally vary the magnetic field distribution formed by the deflection yoke 35. The movements on the fluorescent screen, of the three electron beams ER, EG and EB due to the local variation of this magnetic field distribution are made different because of the difference between the respective effects of said local variation upon said three electron beams. In addition, the greatness and direction of the movements of the three electron beams ER, EG and EB are made different depending upon the configuration, size, attachment position $\theta$, or attachment angle $\Psi$ of the soft magnetic material pieces 41 to 44. Accordingly, if such dimensions are appropriately determined, it will be possible to correct the mis-convergence $MC_6$ occurring at four corners of the screen.

It will hereinafter be explained taking examples how the relative movements of the three electron beams ER, EG and EB are varied in accordance with the size of the soft magnetic material pieces 41 to 44, the condition wherein they are fitted to the deflection yoke 35, etc.

At the front end portion of the deflection yoke 35 mounted on a color picture tube having in-line arranged electron guns whose screen size is 20 inch and whose electron beam deflecting angle is 110°, rectangular magnetic material pieces 41 to 44 (whose magnetic permeability $\mu = 3500$) each having a width a of 60 mm, a length $b$ of 40 mm and a thickness $c$ of 0.25 mm are fitted to one side face of the yoke holder 45 in a manner inclined at an angle $\Psi$ of 30° to the Y axis. When, in this arrangement, the attachment position $\theta$ is varied, the relative movements at the right upper corner of the screen between the center beam EG and each of the side beams ER, EB are made as shown in FIGS. 17A and 17B. That is to say, FIG. 17A shows the vertical movement $\Delta y$ and FIG. 17B the horizontal movement $\Delta x$ of the electron beams. Note that positive and negative numerical values of each of the $\Delta y$ and $\Delta x$ represent the direction in which the electron beams go away from the horizontal and vertical center axes passing through the center of the screen and the direction in which the electron beams come near to said horizontal and vertical center axes, respectively. As apparent from FIGS. 17A and 17B, with respect to the vertical movement, the movement of one side beam EB in a direction in which it goes away from the horizontal center axis of the screen relatively to the center beam EG becomes great as the $\theta$ increases, whereas the movement of the other side beam ER in a direction in which it comes near to the horizontal center axis of the screen relatively to the center beam EG becomes great as the $\theta$ increases. With respect to the horizontal movement, the side beams ER and EB move in a direction in which both of them are aligned with the center beam EG, but this horizontal movement $\Delta x$ is extremely small as compared with the vertical movement $\Delta y$. For this reason, if the $\theta$ is adjusted within the range of 45° to 70°, a vertical mis-convergence will be able to be corrected practically.

FIGS. 18A and 18B show the movements of the side beams ER, EB relative to the center beam EG in the case where the attachment angle $\Psi$ of the same magnetic material pieces 41 to 44 as those in FIGS. 17A and 17B is varied with the $\theta$ set at 60°. With respect to the vertical movement $\Delta y$ of the electron beams, the side beam ER has a tendency to slightly approach the center beam EG, whereas the side beam EB is little moved relatively. With respect to the horizontal movement $\Delta x$, the three electron beams are aligned with each other in the proximity of $\Psi = 35°$ and, with this point as a boundary, one side beam EB tends to move toward the vertical axis of the screen relative to the center beam EG as the $\Psi$ increases, whereas the other side beam ER tends to retreat from the vertical axis of the screen relatively to the center beam EG as the $\Psi$ increases.

FIGS. 19A, 19B, 19C, 19D, 19E and 19F show the movements at the right upper corner of the screen, of both side beams ER, EB relative to the center beam EG in the case where the width a, length b and thickness c of the magnetic material pieces 41 to 44 are varied. As apparent from FIGS. 19A, 19B, 19C, 19D, 19E and 19F, with respect to the vertical movement, when the width a of the magnetic material pieces 41 to 44 is increased, the side beam EB is greatly moved toward the horizontal center axis of the screen relative to the center beam EG, whereas when the thickness c of the magnetic material pieces 41 to 44 is increased, the side beam EB is greatly moved in a direction in which it goes away from the horizontal center axis of the screen relative to the center beam EG. In the case of the width a and the thickness $c$ being varied, the horizontal movement of the electron beams is little varied. In the case of the length $b$ being varied, the horizontal movement of the electron beams has a tendency to become great as the length $b$ is increased, though the vertical movement of the electron beams is little varied.

FIGS. 20A, 20B, 20C, 20D, 20E and 20F show the similar movements of both side beams ER, EB relative to the center beam EG in the case where $\theta = 55°$ and $\Psi = 0°$. As seen, the vertical and horizontal movements of the electron beams have a tendency similar to that shown in FIGS. 19A, 19B, 19C, 19D, 19E and 19F.

Hereinafter, explanation is made, in accordance with the results of actual measurements, of the circumstances of the correction of the mis-convergences in the case where magnetic material pieces each of the dimensions $a = 60$ mm, $b = 40$ mm and $c = 0.25$ mm and of the magnetic permeability $\mu = 3500$ are fitted to the front end portion of the deflection yoke 35 under the condition wherein $\theta = 65°$ and $\Psi = 0°$. When measurement was made of the vertical movements of the three electron beams at a corner position of the screen shifted 135 mm from the screen center in the Y axial direction and shifted 180 mm from the screen center in the X axial direction, one side beam, center beam and the other side beam were moved 1.8 mm, 1.3 mm and 0.9 mm in the vertical deflecting direction, respectively. Accordingly, the interval between both side beams is reduced by the extent of 0.9 mm. At this time, each of said three electron beams was moved 1.5 mm toward the Y axis i.e., in the horizontal direction. In contrast, at a position shifted 85 mm in the Y axial direction and spaced 100 mm in the X axial direction, the vertical and horizontal movements of each of the three electron beams were in the range of 0.2 mm or less. That is, it has been proved that the effect upon the screen center portion, of the fitting of the magnetic material pieces to the front end portion of the deflection yoke is practically negligibly small. Where, in this manner, the magnetic material pieces are fitted to the front end portion of the deflection yoke 35, mis-convergences occurring at the peripheral portion of the screen of the color picture tube can be corrected with no practical effect upon the convergences at the remaining portion of the screen.

Primary color signals SR, SG and SB corresponding to the three primary colors of red, green and blue are supplied from a color television receiver body (not shown) to the three electron guns 34R, 34G and 34B of FIG. 8 so as to permit the electron beams ER, EG and EB to be independently modulated. In FIG. 8, a reference numeral 36 denotes a primary color signal demodulation circuit, and the red-primary color signal SR of the three primary color signals SR, SG and SB demodulated by this modulation circuit 36 is directly amplified by a video amplifier 38R to a prescribed amplitude and is thereafter supplied to the electron gun 34R so as to modulate the electron beam ER. The green-primary color signal SG is supplied to a delay circuit 37G and subject there to a time delay of tG, and after amplified by a video amplifier 38G to a prescribed amplitude, is supplied to the electron gun 34G so as to modulate the electron beam EG. The blue-primary color signal SB is supplied to a delay circuit 37B and subject there to a time delay of $t$B and then is amplified by a video amplifier 38 to a prescribed amplitude and then is supplied to the electron gun 34B so as to modulate the electron beam EB.

The length of time $t$G by which the primary color signal SG is delayed by the delay circuit 37G and the length of time tB by which the primary color signal SB is delayed by the delay circuit 37B are given for the purpose of spatially correcting the picture image displacement due to the interval D between the electron beam spots on the fluorescent screen 32. Accordingly, when the lateral width of the fluorescent screen 32 is represented by $W_H$ (mm) and the horizontal scanning frequency by $f_H$ (Hz), said lengths of times $t$G and $t$B are so determined as to satisfy the following inequalities.

$$0.8/W_H f_H < tG < 0.65d/W_H f_H \quad (2).$$

$$1.6/W_H f_H < tB < 1.3d/W_H f_H \quad (3).$$

Note that it is desirable that where the picture quality, discriminating limit, manufacturing cost, etc. are taken into consideration, said delay times be set at about 0.15 microseconds.

An example of a delay circuit giving the above-mentioned delay times is shown in FIG. 21. This example is a delay circuit constructed using an LC type delay line having intermediate taps. In FIG. 21, a reference numeral 51 denotes a delay line, 52 at-the-input-end matching impedance element, 53 an output terminating impedance element, 54*a* to 54*d* a plurality of intermediate taps equidistantly provided sequentially from the output end-side of the delay line 51, 55 an intermediate tap changer, and 56 a buffer. These intermediate taps 54*a* to 54*d* are provided, considering that a small deviation occurs in a prescribed length of delay time due to a minute deviation in the arranging accuracy of the electron guns 34R, 34G and 34B or a minute deviation in the distribution of magnetic field produced by the deflection yoke 35, for the purpose of adjusting said small deviation. Accordingly, where this deviation is extremely small to have no substantial effect upon the prescribed length of delay time, said intermediate taps 54*a* to 54*d* do not have to be necessarily provided. A length of delay time tT between said intermediate taps is determined from the limit within which color displacement on the fluorescent screen 32 is permissible. That is to say, the tT should be so determined as to meet the following inequality.

$$tT < 1/W_H f_H$$

In the case of using the above-constructed delay circuit in place of the delay circuits 37G and 37B of FIG. 8, the delay time of the delay line 51, that is, the length of time required for a signal applied to an input terminal $51_{IN}$ of the delay line 51 to reach an output terminal $51_{OUT}$ of the delay line 51 has only to be set as to satisfy the requirements of said unequalities (2) and (3).

Hereinafter, the operation of the embodiment of the invention having the foregoing construction is explained. For convenience of explanation, description is made on the temporary assumption that the delay circuits 37G and 37B are not provided. The primary color signals SR, SG and SB demodulated by the demodulation circuit 36 are amplified by the video amplifiers 38R, 38G and 38B, respectively, and then are supplied to the electron guns 34R, 34G and 34B, respectively, at the same time. For this reason, the three electron beams ER, EG and EB emitted from the electron guns 34R, 34G and 34B, respectively, are respectively modulated by the primary color signals and then are allowed to impinge upon the fluorescent screen 32.

Since a converged point of the three electron beams ER, EG and EB is situated outside of the fluorescent screen 32, the respective impingement positions of the three electron beams are arranged such that each of the side beams ER, EB is spaced by the distance of D from the center beam EG. These three electron beams ER, EG and EB are horizontally and vertically deflected by the deflection yoke 35 and scan the fluorescent screen 32. Even if, at this time, the three electron beams ER, EG and EB are horizontally deflected thus to scan the peripheral portion of the screen, the beam-to-beam's interval D will be subject to little variation since, as above described, a converged point of the three electron beams is situated outside of the screen 32. In addition, the magnetic field for horizontal deflection assumes a pincushion-like configuration and the magnetic field for vertical deflection assumes a barrel-like configuration and yet the magnetic material pieces 41 to 44 are axis-symmetrically fitted to the front end portion of the deflection yoke 35. For this reason, as shown in FIG. 22, the mis-convergences at the central part of the screen are corrected and simultaneously the mis-convergence $MC_6$ at the peripheral portion, particularly four corners of the screen is completely corrected or removed. However, if any further step is taken, color displacement will occur in the color picture image since the mutual interval between the center beam EG and each of the side beams ER, EB is kept at D.

Suppose now that the length of delay time tG corresponding to the interval D between the electron beams ER and EG is given to the primary color signal by the delay circuit 37G and that the length of delay time corresponding to the interval 2D between the electron beams ER and EB is given to the primary color signal SB by the delay circuit 37B. Then, picture images formed by the respective electron beams ER, EG and EB are allowed to spatially coincide with each other and therefore any color displacement does not take place.

Note here that what is important is that the lengths of delay times allotted to the delay circuits 37G and 37B are respectively fixed at all times and are not varied depending upon the scanning region.

This invention is not limited to the foregoing embodiment but can be practised in various modifications. That is to say, the magnetic material piece is not limited to a rectangular configuration but may be formed into an elliptical configuration, a semicircular configuration, or a bent plate-like configuration such as an L shape or U shape. Further, with respect to the magnetic material piece, the one whose configuration and size are predetermined may be fixedly fitted to the deflection yoke, or may be fitted to the deflection yoke with some tolerance left for adjustment so that the attachment position of the magnetic material piece can be varied after it has been fitted. Further, various kinds of magnetic material pieces of different configurations and sizes are prepared in advance and a suitable kind of magnetic material piece selected from these pieces may be fitted. Further, the preceding embodiment referred to the case where the magnetic material pieces of the same configuration and size were fitted, under the same condition, at four positions axis-symmetrical with respect to the Y and X axes of the deflection yoke, but the magnetic material pieces of different configurations and sizes may be fitted at said positions so as to absorb errors in manufacturing the color picture tube and deflection yoke and unsymmetrical mis-convergences produced in combining both. Further, it is not necessary that one magnetic material piece is fitted at each of said four positions. The point is that the magnetic material pieces have only to be fitted at positions symmetrical with respect to each of two planes including therein the axial center of the deflection yoke and being in parallel with the horizontal and vertical deflecting directions, respectively.

The preceding embodiment referred to the case where, on the premise that the dynamic convergence means are not used at all, this invention was applied to the color picture tube of in-line arranged beam system, but this invention may be used as a supplementary means for dynamic convergence and in this sense can be widely applied to the color picture tube of in-line arranged beam system and of in-line arranged beam system and of Δ-arranged beam system. Further, the preceding embodiment referred to the case where this invention was applied to the color picture tube of the system wherein a converged point of the three electron beams is situated outside of the fluorescent screen, but can of course be applied also to the color picture tube of the system wherein the three electron beams are converged at one point of the fluorescent screen.

What we claim is:

1. In a deflection device for use in a color television receiver, which is fitted to a neck portion of a color picture tube having electron guns emitting three electron beams, said electron guns being arranged in a horizontal plane and which comprises a deflection yoke for horizontally and vertically deflecting said three electron beams on a screen and at least a soft magnetic material piece fitted on said deflection yoke, the improvement which comprises a deflection yoke which is so designed as to eliminate mis-convergences $MC_1$, $MC_2$, $MC_3$, $MC_4$ and $MC_7$, in the mis-convergence $MC_1$ the three electron beams being horizontally displaced from each other at both the upper and lower end portions of the vertical or Y axis, in the mis-convergence $MC_2$, the three electron beams being vertically displaced from each other at both the upper and lower end portions of the Y axis, in the mis-convergence $MC_3$, the three electron beams being horizontally displaced from each other at both the right and left end portions of the horizontal or X axis, in the mis-convergence $MC_4$ three electron beams being vertically displaced from each other at both the right and left end portions of the X axis, and in the misconvergence $MC_7$ scanning lines of the three electron beams being vertically displaced at intermediate portions between the Y axis and each of said right and left ends of the screen; and at least a soft magnetic material piece fitted to an end portion of said deflection yoke nearer to the screen of the color picture tube so as only to eliminate a mis-convergence $MC_5$ wherein the three electron beams are horizontally displaced from each other at the diagonal end portions of the screen and a mis-convergence $MC_6$ wherein the three electron beams are vertically displaced from each other at the diagonal end portions of the screen.

2. A deflection device according to claim 1, wherein said soft magnetic piece defines an angle $\theta$ of 45° to 70° with a vertical line of the color picture tube.

3. A deflection device according to claim 1 wherein said soft magnetic material pieces are fitted at positions symmetrical with respect to each of two planes including therein the axial center of said deflection yoke and being in parallel with the horizontal and vertical deflecting directions, respectively.

4. A deflection device according to claim 1 wherein said soft magnetic material pieces have a configurational anisotropy.

5. A deflection device according to claim 1 wherein said soft magnetic material pieces are constructed so that at least either one of their configurational anisotropy and attachment position can be varied.

* * * * *